US007626553B2

(12) United States Patent
Park et al.

(10) Patent No.: US 7,626,553 B2
(45) Date of Patent: Dec. 1, 2009

(54) METHOD OF AUTOMATICALLY COMPENSATING SENSITIVITY OF MOBILE COMMUNICATION TERMINAL AND THE MOBILE COMMUNICATION TERMINAL

(75) Inventors: Jun Han Park, Gyeonggi-do (KR); Jong Wook Jeong, Gyeonggi-do (KR)

(73) Assignee: Pantech Co., Ltd., Seoul (KR)

( * ) Notice: Subject to any disclaimer, the term of this patent is extended or adjusted under 35 U.S.C. 154(b) by 656 days.

(21) Appl. No.: 11/387,330

(22) Filed: Mar. 23, 2006

(65) Prior Publication Data

US 2007/0126643 A1 Jun. 7, 2007

(30) Foreign Application Priority Data

Dec. 2, 2005 (KR) ..... 10-2005-0116671

(51) Int. Cl.
*H01Q 1/24* (2006.01)

(52) U.S. Cl. ..... 343/702; 455/277.1

(58) Field of Classification Search ..... 343/702; 455/277.1

See application file for complete search history.

(56) References Cited

U.S. PATENT DOCUMENTS

| | | | | |
|---|---|---|---|---|
| 7,081,853 | B2 * | 7/2006 | Amano et al. | 343/702 |
| 7,359,692 | B2 * | 4/2008 | Saed et al. | 455/277.1 |

FOREIGN PATENT DOCUMENTS

| | | |
|---|---|---|
| JP | 06-311067 | 11/1994 |
| JP | 11-298231 | 10/1999 |
| JP | 2004-096341 | 3/2004 |
| KR | 1020040028162 | 4/2004 |
| KR | 10-2005-0061867 A | 6/2005 |

OTHER PUBLICATIONS

Office Action dated Nov. 21, 2006 issued from the Korean Patent office in connection with Korean Patent Application No. 10-2005-0116671.

* cited by examiner

*Primary Examiner*—Tan Ho
(74) *Attorney, Agent, or Firm*—H.C. Park & Associates, PLC

(57) ABSTRACT

A mobile communication terminal, including an automatic sensitivity improvement intenna, wherein the automatic sensitivity improvement intenna includes: a first intenna whose antenna sensitivity is tuned in an idle state at a free space; and a second intenna for improving sensitivity by checking received signal strength indication when the mobile communication terminal is engaged.

7 Claims, 4 Drawing Sheets

METHOD OF AUTOMATICALLY COMPENSATING SENSITIVITY OF MOBILE COMMUNICATION TERMINAL AND THE MOBILE COMMUNICATION TERMINAL

CROSS-REFERENCE TO RELATED APPLICATIONS

This application claims the benefit of Korean Patent Application No. 10-2005-0116671, filed on Dec. 2, 2005, in the Korean Intellectual Property Office, the disclosure of which is incorporated herein in its entity by reference.

BACKGROUND OF THE INVENTION

1. Field of the Invention

The present invention relates to a method of improving sensitivity of a mobile communication terminal equipped with an automatic sensitivity improvement intenna including a first intenna and a second intenna, in which the second intenna is in an idle state at a free space and is moved out of the first intenna to improve the sensitivity of the mobile communication terminal when received signal strength indication (RSSI) is reduced to less than a predetermined level, and the mobile communication terminal employing the method.

2. Description of the Related Art

Currently, since incredible development rapidly accelerates popularization of mobile communication terminals, most people always carry a mobile communication terminal such as a mobile phone and PDA. Such mobile communication terminals provide not only a phone call with another person but also short message services, thereby quickly and easily contacting another person.

FIG. 1 is a top view illustrating an intenna installed in a mobile communication terminal according to a conventional technology.

A mobile communication terminal may include an antenna for transmitting and receiving a predetermined electric wave such as call connection, message communication, and wireless Internet. The antenna may convert an electric signal into an electric wave and may transmit the electric wave. The antenna may receive an electric wave and may convert the electric wave into an electric signal.

The mobile communication terminal may use an external antenna attached to be protruded outside the mobile communication terminal or an internal antenna (intenna) attached to the inside of the mobile communication terminal.

A mobile communication terminal 100 equipped with an intenna 110 has merits of minimizing a terminal and reducing inconvenience in use by installing an antenna that was attached to the outside of a mobile communication terminal, inside the mobile communication terminal 100. Also, since a low specific absorption rate (SAR) value may be acquired and a low-priced antenna may be developed, many mobile communication terminals including an intenna have been developed.

However, in the case of the intenna 110, effective bandwidth is narrower than with an external antenna, efficiency is low, and a hand effect of a user is great. The hand effect indicates that sensitivity is reduced because an antenna characteristic deteriorates when the user holds the mobile communication terminal by hand during a call.

To prevent a reduction in sensitivity due to the hand effect, manufacturers of mobile communication terminals have developed mobile communication terminals in which the intenna 110 is in the lower portion of a microphone. However, a basic problem of the hand effect, which reduces the sensitivity of the mobile communication terminal, cannot be solved by moving the intenna 110 toward the microphone.

As described above, a new method of improving performance of the mobile communication terminal including the intenna by decreasing the hand effect of the mobile communication terminal including the intenna is exceedingly required.

SUMMARY OF THE INVENTION

The present invention provides a method of maintaining an optimal sensitivity, in which an automatic sensitivity improvement intenna including a first intenna whose antenna sensitivity is tuned in an idle state at a free space and a second intenna for improving sensitivity by checking received signal strength indication (RSSI) when a mobile communication terminal is engaged is installed in the mobile communication terminal and the second intenna improves sensitivity of the mobile communication terminal when the RSSI of the mobile communication terminal is reduced to be less than a predetermined level, and the mobile communication terminal employing the method.

The present invention also provides a method of preventing a reduction in sensitivity due to a hand effect, in which an automatic sensitivity improvement intenna including a first intenna and a second intenna is installed in a mobile communication terminal and the second is located within the first intenna and is moved out of the first intenna to improve sensitivity of the mobile communication terminal when the RSSI is reduced to be less than a predetermined level, thereby preventing a reduction of the sensitivity due to the hand effect, and the mobile communication terminal employing the method.

The present invention also provides a method of minimizing a mobile communication terminal, in which a first intenna is connected to a second intenna by an antenna connection contact pin and the second intenna is moved out of the first intenna by a predetermined power unit, sensitivity of a mobile communication terminal is improved to prevent a reduction of sensitivity due to the hand effect, thereby minimizing the mobile communication terminal.

According to an aspect of the present invention, there is provided a mobile communication terminal including an automatic sensitivity improvement intenna, in which a first intenna whose antenna sensitivity is tuned in an idle state at a free space and a second intenna for improving the sensitivity by checking the RSSI when the mobile communication terminal is engaged.

The mobile communication terminal may include a computer terminal, a communication terminal, a Public Switched Telephone Network (PSTN) terminal, VoIP, Session Initiation Protocol (SIP), Megaco, Personal Digital Assistant (PDA), a cellular phone, Personal Communication Service (PCS) phone, a hand-held PC, CDMA-2000 (1× and 3×) phone, a wideband CDMA phone, a dual band/dual mode phone, a Global Standard for Mobile (GSM) phone, a Mobile Broadband System (MBS) phone, or a Digital Multimedia Broadcasting (DMB) phone.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
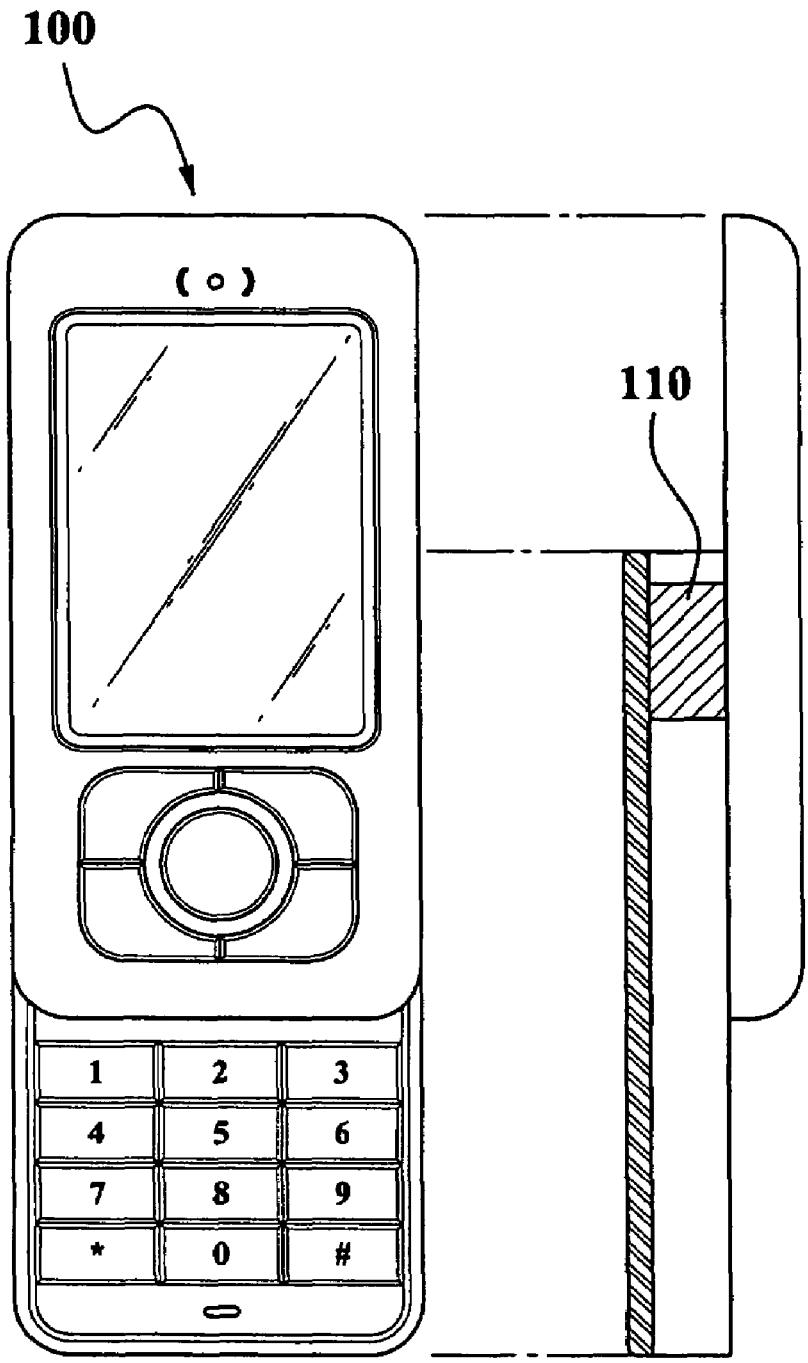
FIG. 1 (PRIOR ART)
FIG. 1 is a top view illustrating an intenna installed in a mobile communication terminal according to a conventional technology.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 2:
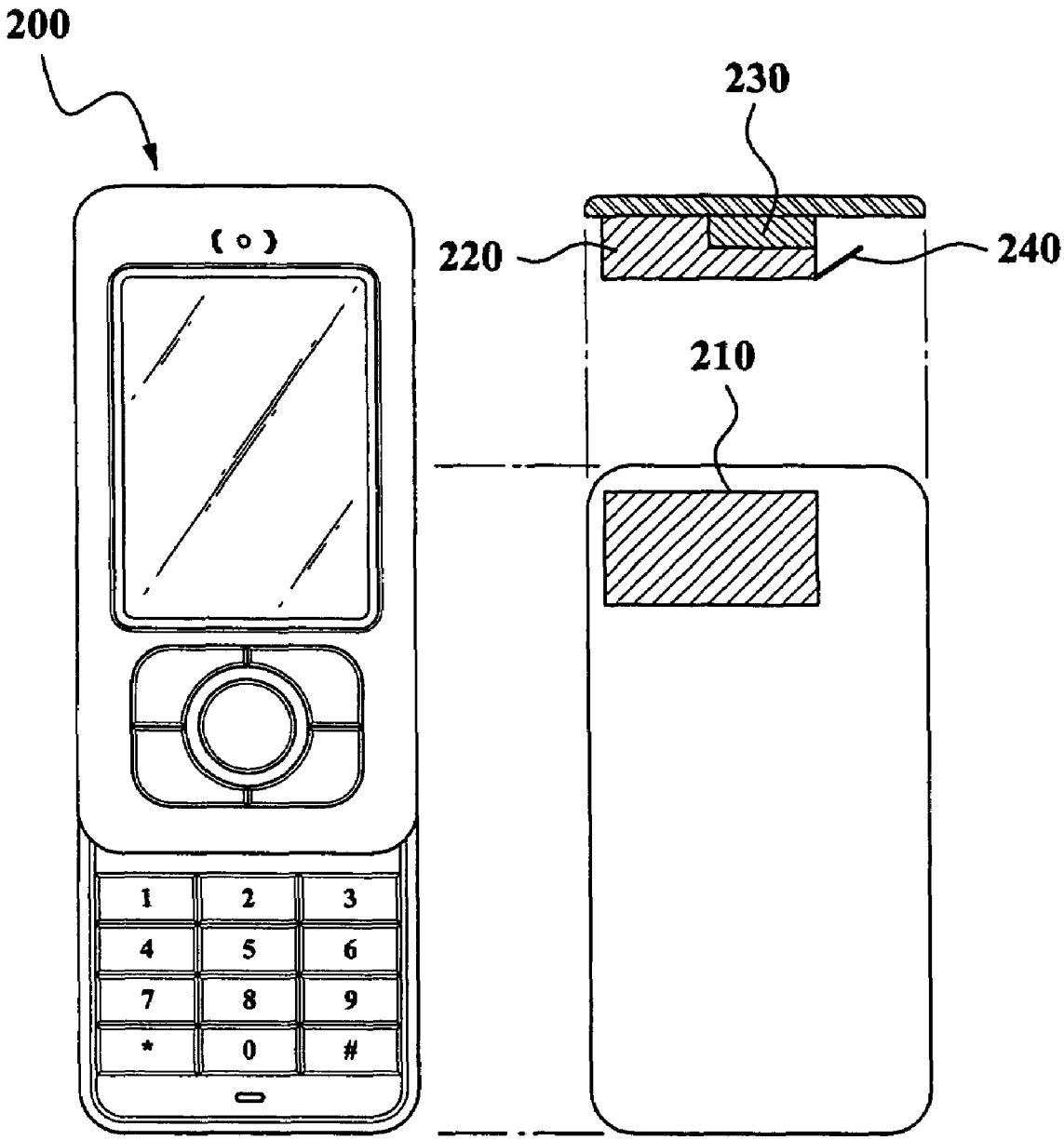
FIG. 2 is a top view illustrating an automatic sensitivity improvement intenna installed in a mobile communication terminal, according to an embodiment of the present invention.

FIG. 2 is a top view illustrating an automatic sensitivity improvement intenna 210 installed in a mobile communication terminal 200, according to an embodiment of the present invention.

The mobile communication terminal 200 includes the automatic sensitivity improvement intenna 210. The automatic sensitivity improvement intenna 210 includes a first intenna 220 and a second intenna 230.

The automatic sensitivity improvement intenna 210 may be equipped with the first intenna 220 and the second intenna 230 disposed within the first intenna 220. The automatic sensitivity improvement intenna 210 may check received signal strength indication (RSSI) of the mobile communication terminal 200 to improve sensitivity according to the RSSI of the mobile communication terminal 200 and may improve the sensitivity of the mobile communication terminal 200 by moving the second intenna 230 out of the first intenna 220 when the RSSI indication is reduced to be less than a predetermined level.

In detail, the first intenna 220 may tune antenna sensitivity in an idle state at a free space. The first intenna 220 may maintain optimal antenna sensitivity for transmitting and receiving electric waves in the idle state at the free space. For example, when the RSSI is maintained to be more than a predetermined level, the first intenna 220 may converting an electric signal into an electric wave to transmit or may receive and convert an electric wave into an electric signal.

The RSSI is an abbreviation of received signal strength indication and may be a strength of a received signal in a mobile communication terminal displayed as bars. Electric power received by the mobile communication terminal may usually be within −108 to 20 dBm. The number of bars of the RSSI and how many bars are displayed at how much electric power may be different for each manufacturer of mobile communication terminals.

According to an embodiment of the present invention, when the RSSI is maintained to be more than the predetermined level, the second intenna 230 may not perform intenna function. For example, when the RSSI is maintained to be more than the predetermined level, since a user perceives this predetermined level as a maximum signal level, transmitting and receiving electric waves may be possible by using only the first intenna 220.

However, when the RSSI is reduced to be less than the predetermined level, since the maximum signal level cannot be maintained by using only the first intenna 220, the second intenna 230 may be coupled with the first intenna 220 and may contribute to transmitting and receiving the electric waves.

For this, the second intenna 230 may be located in the first intenna 220 in the idle state at the free space and may check the RSSI of the mobile communication terminal 200. The second intenna 230 may check the RSSI when the mobile communication terminal 200 is engaged and may be moved out of the first intenna 220 when the RSSI is reduced to be less than a predetermined level (refer to FIG. 3).

The predetermined level may be determined according to received signal strength perceived by the user.

For example, when the sensitivity perceived by the user is determined to be high at a third level but determined to be low at a second level, the predetermined level may be determined to be the second level. Also, as described above, since a standard for displaying the RSSI is different for each manufacturer of mobile communication terminals, the predetermined level for each manufacturer of mobile communication terminals may be determined to be different.

According to an embodiment of the present invention, the automatic sensitivity improvement intenna 210 may include a predetermined power unit (not shown), and the second intenna 230 may be moved out of the first intenna 220 by the operation of the power unit. Also, the first intenna 220 may be connected to the second intenna 230 by an antenna connection contact pin 240.

Also, according to the present embodiment, since the mobile communication terminal includes the automatic sensitivity improvement intenna 210 including the first intenna 220 and the second intenna 230, the second intenna 230 is in the first intenna 220 in the idle state at the free space and is moved out of the first intenna 220 to improve sensitivity of the mobile communication terminal 200 when the RSSI of the mobile communication terminal is reduced to be less than the predetermined level, thereby maintaining optimal sensitivity.

Figure 3:
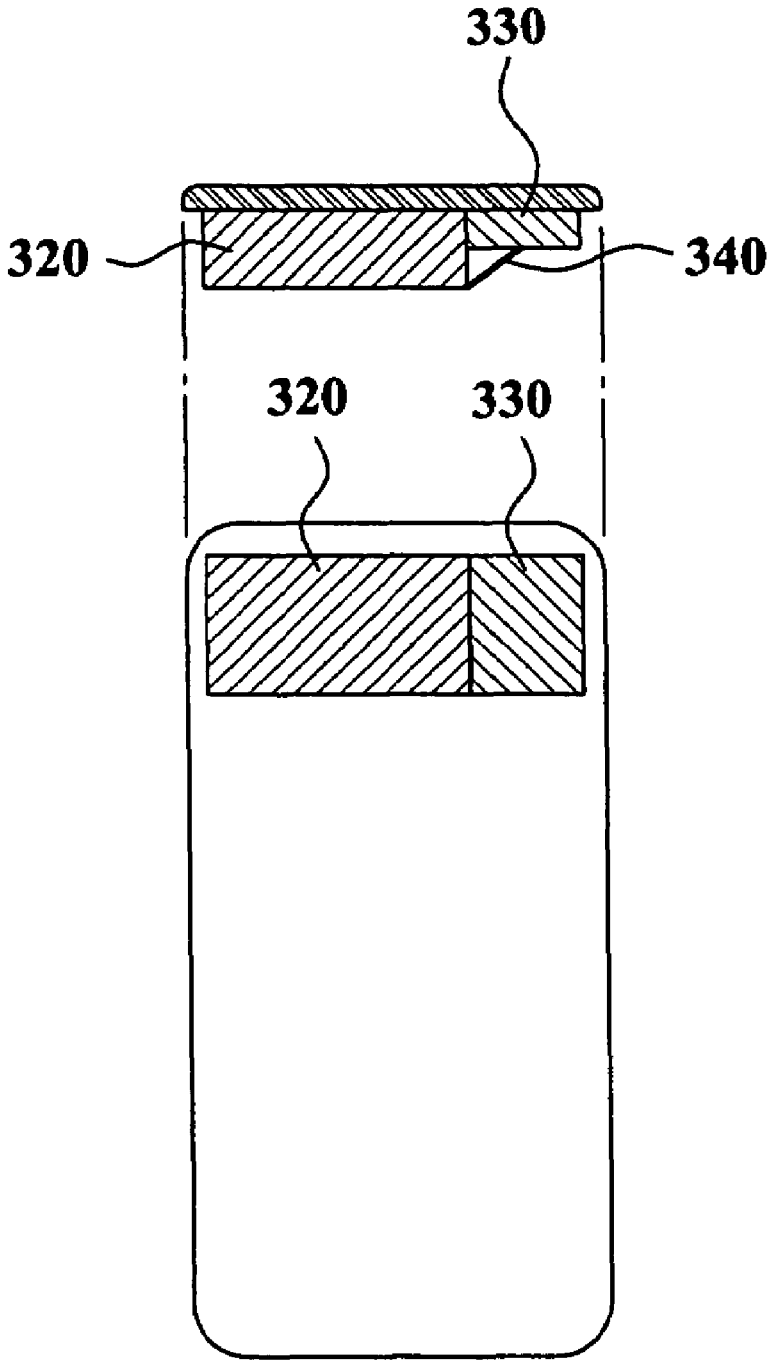
FIG. 3 is a top view illustrating that a second intenna is moved out of a first intenna for improving sensitivity.

FIG. 3 is a top view illustrating that the second intenna 330 is moved out of the first intenna 320 for improving sensitivity.

As illustrated, the RSSI is reduced to be less than the predetermined level when the mobile communication terminal is engaged and the second intenna 330 is moved out of the first intenna 320. The automatic sensitivity improvement intenna 210 includes the antenna connection contact pin 340, and the first intenna 320 may be connected to the second intenna 330 by the antenna connection contact pin 340.

Also, according to the present embodiment, the mobile communication terminal includes the automatic sensitivity improvement intenna 210 including the first intenna 220 and the second intenna 230 and the second intenna 230 is moved out of the first intenna 220 and improves the sensitivity of the mobile communication terminal when the RSSI is reduced to be less than the predetermined level, thereby preventing the reduction of the sensitivity due to a hand effect.

Figure 4:
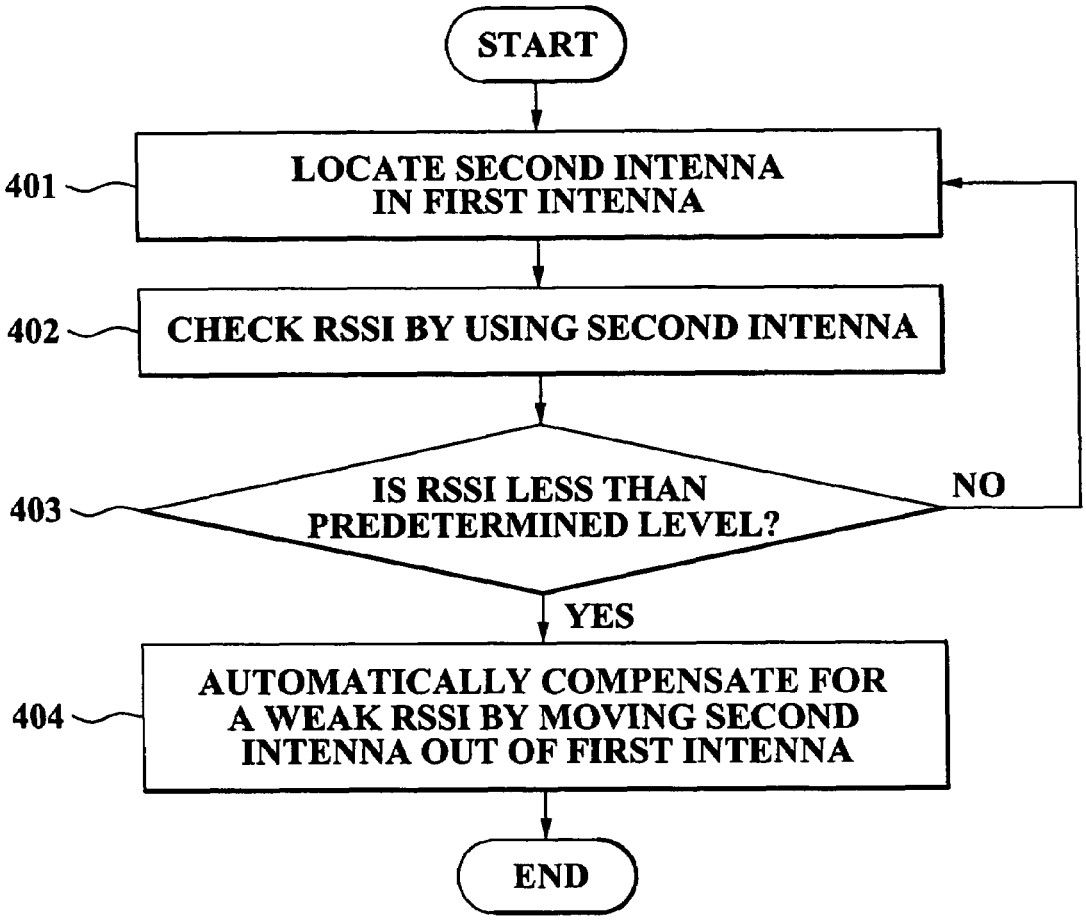
FIG. 4 is a flowchart illustrating a method of automatically improving sensitivity of a mobile communication terminal.

FIG. 4 is a flowchart illustrating a method of automatically improving sensitivity of a mobile communication terminal.

In 401, the second intenna 230 may be located in the first intenna 220 in the idle state at the free space. According to the present embodiment, in the idle state, the first intenna 220, as an antenna, may take part in transmitting and receiving electric waves of the mobile communication terminal 200, but the second intenna 230 may not perform as an antenna.

In 402 and 403, the second intenna may check the RSSI of the mobile communication terminal 200 during the mobile communication terminal 200 is engaged and may determine whether the RSSI is reduced to be less than the predetermined level. The RSSI may be a strength of a received electric displayed in bars in the mobile communication terminal 200.

When the RSSI is reduced to be less than the predetermined level, in 404, the second intenna 330 may be moved out of the first intenna 320 and may automatically improve the RSSI.

Also, according to the present embodiment, the first intenna is connected to the second intenna by using the antenna connection contact pin, the second intenna is moved out of the first intenna by the predetermined power unit, and the second intenna improves the sensitivity of the mobile communication terminal to prevent the reduction of the sensitivity due to the hand effect, thereby minimizing a mobile communication terminal.

Also, the method of automatically improving sensitivity of a mobile communication terminal, according to the present invention, may include a computer readable medium including a program instruction for executing various operations realized by a computer. The computer readable medium may include a program instruction, a data file, and a data structure, separately or cooperatively. The program instructions and the media may be those specially designed and constructed for the purposes of the present invention, or they may be of the kind well known and available to those skilled in the art of computer software arts. Examples of the computer readable media include magnetic media (e.g., hard disks, floppy disks, and magnetic tapes), optical media (e.g., CD-ROMs or DVD), magneto-optical media (e.g., floptical disks), and hardware devices (e.g., ROMs, RAMs, or flash memories, etc.) that are specially configured to store and perform program instructions. The media may also be transmission media such as optical or metallic lines, wave guides, etc. including a carrier wave transmitting signals specifying the program instructions, data structures, etc. Examples of the program instructions include both machine code, such as produced by a compiler, and files containing high-level languages codes that may be executed by the computer using an interpreter.

According to the present invention, an automatic sensitivity improvement intenna including a first intenna whose antenna sensitivity is tuned in an idle state at a free space and a second intenna for improving sensitivity by checking received signal strength indication (RSSI) when a mobile communication terminal is engaged is installed in the mobile communication terminal and the second intenna improves sensitivity of the mobile communication terminal when the RSSI of the mobile communication terminal is reduced to be less than a predetermined level.

According to the present invention, an automatic sensitivity improvement intenna including a first intenna and a second intenna is installed in a mobile communication terminal and the second is in the first intenna in an idle state at a free space and is moved out of the first intenna to improve sensitivity of the mobile communication terminal when the RSSI is reduced to be less than a predetermined level, thereby preventing a reduction of the sensitivity due to a hand effect.

According to the present invention, a first intenna is connected to a second intenna by an antenna connection contact pin, the second intenna is moved out of the first intenna by a predetermined power unit, and sensitivity of a mobile communication terminal is improved to prevent a reduction of sensitivity due to hand effect, thereby minimizing the mobile communication terminal.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A mobile communication terminal, comprising an automatic sensitivity improvement intenna, wherein the automatic sensitivity improvement intenna comprises:

a first intenna whose antenna sensitivity is tuned in an idle state at a free space; and a second intenna to improve sensitivity by checking a received signal strength indication when the mobile communication terminal is engaged, wherein the second intenna is arranged in the first intenna in the idle state at the free space and is moved out of the first intenna when operating to improve the sensitivity.

2. The terminal of claim 1, wherein:

the automatic sensitivity improvement intenna further comprises a power unit, and the second intenna is moved out of the first intenna by operation of the power unit.

3. The terminal of claim 2, wherein, when the received signal strength indication is less than a predetermined level, the second intenna is moved out of the first intenna by the operation of the power unit.

4. The terminal of claim 1, wherein:

the automatic sensitivity improvement intenna comprises a contact pin for antenna connection; and the first intenna is connected to the second intenna by the contact pin for antenna connection.

5. A method of automatically improving sensitivity of a mobile communication terminal, wherein the mobile communication terminal comprises an automatic sensitivity improvement intenna comprising a first intenna whose antenna sensitivity is tuned in an idle state at a free space and a second intenna coupled with the first intenna, comprising the steps of:

the second intenna checking received signal strength indication when the mobile communication terminal is engaged; and in the case the received signal strength indication is reduced to be less than a predetermined level, the second intenna being moved from the inside of the first intenna to the outside of the first intenna and automatically improving the received signal strength indication.

6. The method of claim 5, wherein:

the automatic sensitivity improvement intenna further comprises a predetermined power unit; and in the second intenna being moved from the inside of the first intenna to the outside of the first intenna, the second intenna is moved out of the second intenna by the power unit.

7. A computer readable recording medium in which a program for executing the method of claim 5 is recorded.

* * * * *

UNITED STATES PATENT AND TRADEMARK OFFICE

CERTIFICATE OF CORRECTION

PATENT NO. : 7,626,553 B2
APPLICATION NO. : 11/387330
DATED : December 1, 2009
INVENTOR(S) : Park et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 909 days.

Signed and Sealed this

Second Day of November, 2010

David J. Kappos

David J. Kappos
*Director of the United States Patent and Trademark Office*